US010241451B2

(12) United States Patent
Murakami et al.

(10) Patent No.: US 10,241,451 B2
(45) Date of Patent: Mar. 26, 2019

(54) FIXING APPARATUS AND IMAGE FORMING APPARATUS

(71) Applicant: KONICA MINOLTA, INC., Chiyoda-ku, Tokyo (JP)

(72) Inventors: Masanori Murakami, Toyohashi (JP); Toru Hayase, Toyokawa (JP); Mamoru Fukaya, Nagoya (JP); Hideaki Ikeda, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/873,276

(22) Filed: Jan. 17, 2018

(65) Prior Publication Data

US 2018/0217540 A1 Aug. 2, 2018

(30) Foreign Application Priority Data

Feb. 1, 2017 (JP) ..... 2017-016593

(51) Int. Cl.
*G03G 21/00* (2006.01)
*G03G 15/20* (2006.01)

(52) U.S. Cl.
CPC ..... *G03G 15/2039* (2013.01); *G03G 15/206* (2013.01); *G03G 15/2028* (2013.01);
(Continued)

(58) Field of Classification Search
CPC ..... G03G 15/20; G03G 15/2028; G03G 15/2078; G03G 15/2089; G03G 15/2039;
(Continued)

(56) References Cited

U.S. PATENT DOCUMENTS

2012/0121304 A1 5/2012 Tokuda et al.
2013/0209125 A1 8/2013 Uchitani et al.
(Continued)

FOREIGN PATENT DOCUMENTS

EP 2453318 A2 5/2012
EP 2645179 A2 10/2013
JP 2010276971 A 12/2010

OTHER PUBLICATIONS

Extended European Search Report dated Jun. 27, 2018 issued in counterpart European Application No. 18152961.1.

*Primary Examiner* — Hoang X Ngo
(74) *Attorney, Agent, or Firm* — Holtz, Holtz & Volek PC

(57) ABSTRACT

A fixing apparatus includes: an endless fixing belt; a pad member having a receiving surface and a supported surface; a pressing rotator pressing the fixing belt against the receiving surface and forming a nip portion between an outer circumferential surface of the fixing belt and the pressing rotator; a supporting member supporting the pad member; and a heating source to heat the fixing belt. The supporting member includes a base abutting on the supported surface of the pad member, and an erected wall erected from the base to partition a space inside the fixing belt into an upstream space and a downstream space. The erected wall is disposed upstream or downstream in a recording-material transport direction, from an intermediate position of the nip portion. The heating source is disposed in a larger one of the upstream space and the downstream space.

15 Claims, 11 Drawing Sheets

(52) U.S. Cl.
CPC ..... *G03G 15/2053* (2013.01); *G03G 15/2078* (2013.01); *G03G 15/2089* (2013.01); *G03G 15/2042* (2013.01); *G03G 15/2064* (2013.01); *G03G 2215/2035* (2013.01)

(58) Field of Classification Search
CPC ..... G03G 15/206; G03G 15/2053; G03G 15/2042; G03G 15/2064; G03G 2215/2035
See application file for complete search history.

(56) References Cited

U.S. PATENT DOCUMENTS

| | | | | |
|---|---|---|---|---|
| 2014/0064804 | A1 | 3/2014 | Yamaguchi et al. | |
| 2014/0079453 | A1* | 3/2014 | Arai ..... | G03G 15/20 399/329 |
| 2015/0104230 | A1 | 4/2015 | Uchitani | |

* cited by examiner

FIXING APPARATUS AND IMAGE FORMING APPARATUS

The entire disclosure of Japanese Patent Application No. 2017-016593 filed on Feb. 1, 2017 is incorporated herein by reference in its entirety.

BACKGROUND

Technological Field

The present disclosure relates to a fixing apparatus that causes a toner image formed on a recording material such as paper to be thermally fixed on the recording material, and also relates to an image forming apparatus such as copier, printer, or facsimile including the fixing apparatus installed in an image formation unit forming an image by means of electrophotography. The image forming apparatus is not limited to a specific type such as color or monochrome one.

Description of the Related Art

Generally, as a fixing apparatus included in an electrophotographic image forming apparatus, a fixing apparatus based on a thermal fixing system is used for the sake of thermal efficiency and safety. This fixing apparatus applies heat and pressure to a recording material on which a toner image is formed, to thereby fix the toner image on the recording material. In the fixing apparatus based on the thermal fixing system, usually a recording material on which a toner image is formed is held between a heating rotator and a pressing rotator so as to thermally fix the toner image on the recording material.

Heating rotators configured in different manners are known. Among them, a healing rotator for which an endless fixing belt is used is known. The heating rotator for which the fixing belt is used is configured in the form of a fixing belt unit. The fixing belt unit includes, in addition to the fixing belt, a pad member against which the fixing belt is pressed by the pressing rotator, a supporting member supporting the pad member, and a heating source heating the fixing belt, for example. These components are assembled into the fixing belt unit.

For example, Japanese Laid-Open Patent Publication No. 2010-276971 discloses a fixing apparatus including a fixing belt unit as described above that serves as a heating rotator. In the space inside the fixing belt of the fixing belt unit disclosed in the aforementioned publication, the pad member, the supporting member, and the heating source, for example, are arranged.

It is important for the fixing apparatus to have a heating rotator configured to be compact for the sake of energy saving. This is for the following reasons. The compactness of the heating rotator enables reduction of the thermal capacity of the heating rotator and thereby enables the heating rotator to be heated with less thermal energy. As the heating rotator is compact, its surface area is small, which enables prevention of useless heat dissipation.

In the fixing belt unit disclosed in the above-identified publication, the space inside the fixing belt is substantially divided into two equal spaces by the supporting member, and the heating source is disposed in one of the two spaces. In this case, because the heating source has a considerably large size, the size of the entire fixing belt unit is inevitably large. In the case where the fixing belt unit configured in the above-described manner is used, energy cannot be saved sufficiently.

SUMMARY

An object of the present disclosure is to provide a compact fixing apparatus appropriate for energy saving as well as an image forming apparatus including the fixing apparatus.

In order to achieve the above object, a fixing apparatus according to the present disclosure causes a toner image formed on a recording material to be fixed on the recording material. The fixing apparatus includes a fixing belt, a pad member, a pressing rotator, a supporting member, and a heating source. The fixing belt is endless. The pad member has a receiving surface facing an inner circumferential surface of the fixing belt and a supported surface located opposite to the receiving surface. The pressing rotator is disposed to face an outer circumferential surface of the fixing belt, and forms a nip portion between the pressing rotator and the outer circumferential surface of the fixing belt. The recording material is transported through the nip portion. The supporting member supports the pad member, and the heating source heats the fixing belt. The pressing rotator is rotationally driven, in a state of pressing the fixing belt in a pressing direction toward the receiving surface, to cause the fixing belt to rotate following rotation of the pressing rotator and to slide on the receiving surface. The supporting member includes: a base having a flat plate shape, disposed in a space inside the fixing belt, and abutting on the supported surface, and an erected wall having a flat plate shape and erected from the base in a direction away from a position of the pressing rotator. The erected wall partitions the space inside the fixing belt into an upstream space located upstream in a recording-material transport direction in which the recording material is transported, and a downstream space located downstream in the recording-material transport direction. The erected wall is disposed upstream or downstream in the recording-material transport direction, from an intermediate position of the nip portion in the recording-material transport direction. The heating source is disposed m a larger one of the upstream space and the downstream space.

The foregoing and other objects, features, aspects and advantages of the present invention will become more apparent from the following detailed description of the present invention when taken in conjunction with the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
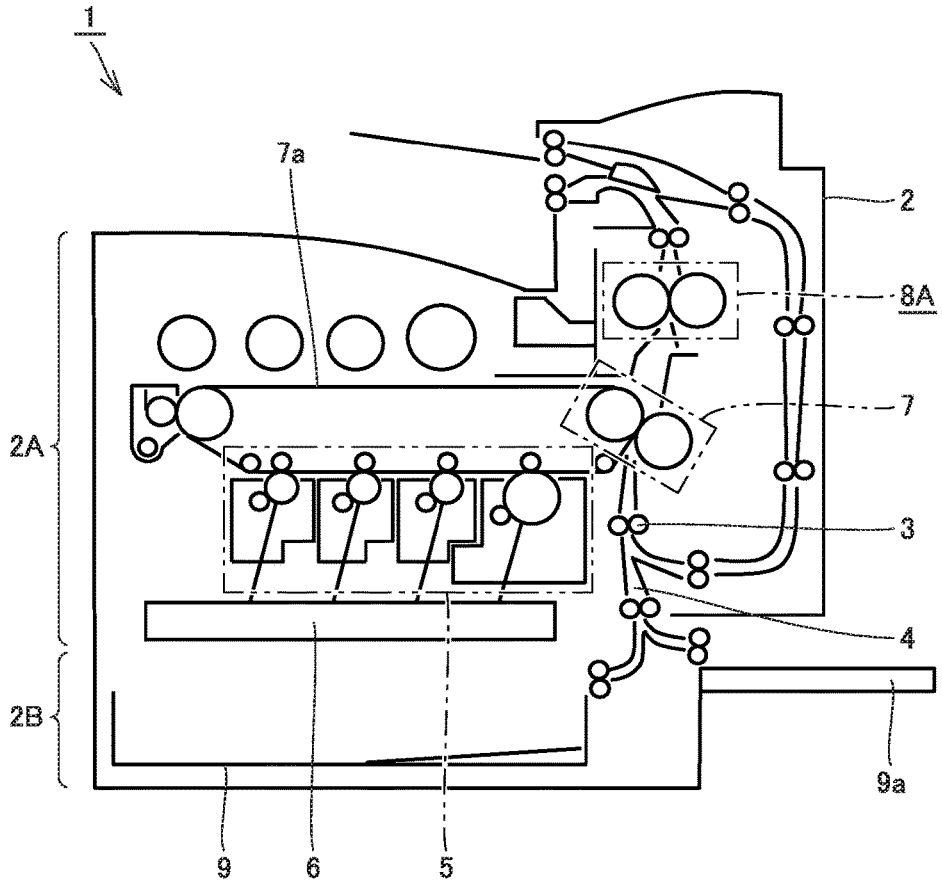
FIG. 1 is a schematic diagram of an image forming apparatus in a first embodiment.

Hereinafter, one or more embodiments will be described with reference to the drawings. However, the scope of the invention is not limited to the disclosed embodiments.

In connection with the embodiments illustrated below, a so-called tandem-type color printer based on electrophotography and a fixing apparatus included in the color printer are described by way of example, as an image forming apparatus and a fixing apparatus to which the present invention is applied. In the following embodiments, the same or common components are denoted by the same reference characters in the drawings, and the description thereof is not repeated.

First Embodiment

FIG. 1 is a schematic diagram of an image forming apparatus in the first embodiment. Referring to FIG. 1, a general configuration of image forming apparatus 1 in the present embodiment is described.

As shown in FIG. 1, image forming apparatus 1 mainly includes an apparatus body 2 and a paper feed unit 9. Apparatus body 2 includes an image forming section 2A for forming an image on a sheet of paper which is fed as a recording material, and a paper feed section 2B for feeding a sheet of paper to image forming section 2A. Paper feed unit 9 contains sheets of paper to be fed to image forming section 2A and is removably disposed in paper feed section 2B.

In image forming apparatus 1, various rollers 3 are disposed in image forming section 2A and paper feed section 2B to form a transport path 4 through which a sheet of paper is transported in a predetermined direction. As shown, a manual feed tray 9*a* may be disposed separately for feeding a sheet of paper to image forming section 2A.

Image forming section 2A mainly includes an image generation unit 5 capable of forming respective a toner image of yellow (Y), magenta (M), cyan (C), and black (K), an exposure unit 6 for exposing a photoreceptor included in image generation unit 5, an intermediate transfer belt 7*a* wound and held in image generation unit 5, a transfer unit 7 disposed on transport path 4 so that transfer unit 7 is located on a path along which intermediate transfer belt 7*a* runs, and a fixing apparatus 8A in the present embodiment described later herein. Fixing apparatus 8A is disposed on transport path 4 and located downstream of transfer unit 7.

Image generation unit 5 forms a toner image of yellow (Y), magenta (M), cyan (C), and black (K), or a toner image of black (K) only, through exposure by exposure unit 6, and transfers the toner image to intermediate transfer belt 7*a* (so-called primary transfer). Accordingly, on intermediate transfer belt 7*a*, a color toner image or a monochrome toner image is formed.

Intermediate transfer belt 7*a* carries, to transfer unit 7, the color toner image or monochrome toner image formed on the surface of intermediate transfer belt 7*a*. At transfer unit 7, the toner image is pressed together with a sheet of paper transported from paper feed section 2B to transfer unit 7. Accordingly, the color toner image or monochrome toner image formed on the surface of intermediate transfer belt 7*a* is transferred to the sheet of paper (so-called secondary transfer).

The sheet of paper to which the color toner image or monochrome toner image is transferred is thereafter pressed and heated by fixing apparatus 8A. Accordingly, a color image or monochrome image is formed on the sheet of paper, and the paper on which the color image or monochrome image is formed is thereafter discharged from apparatus body 2.

Figure 2:
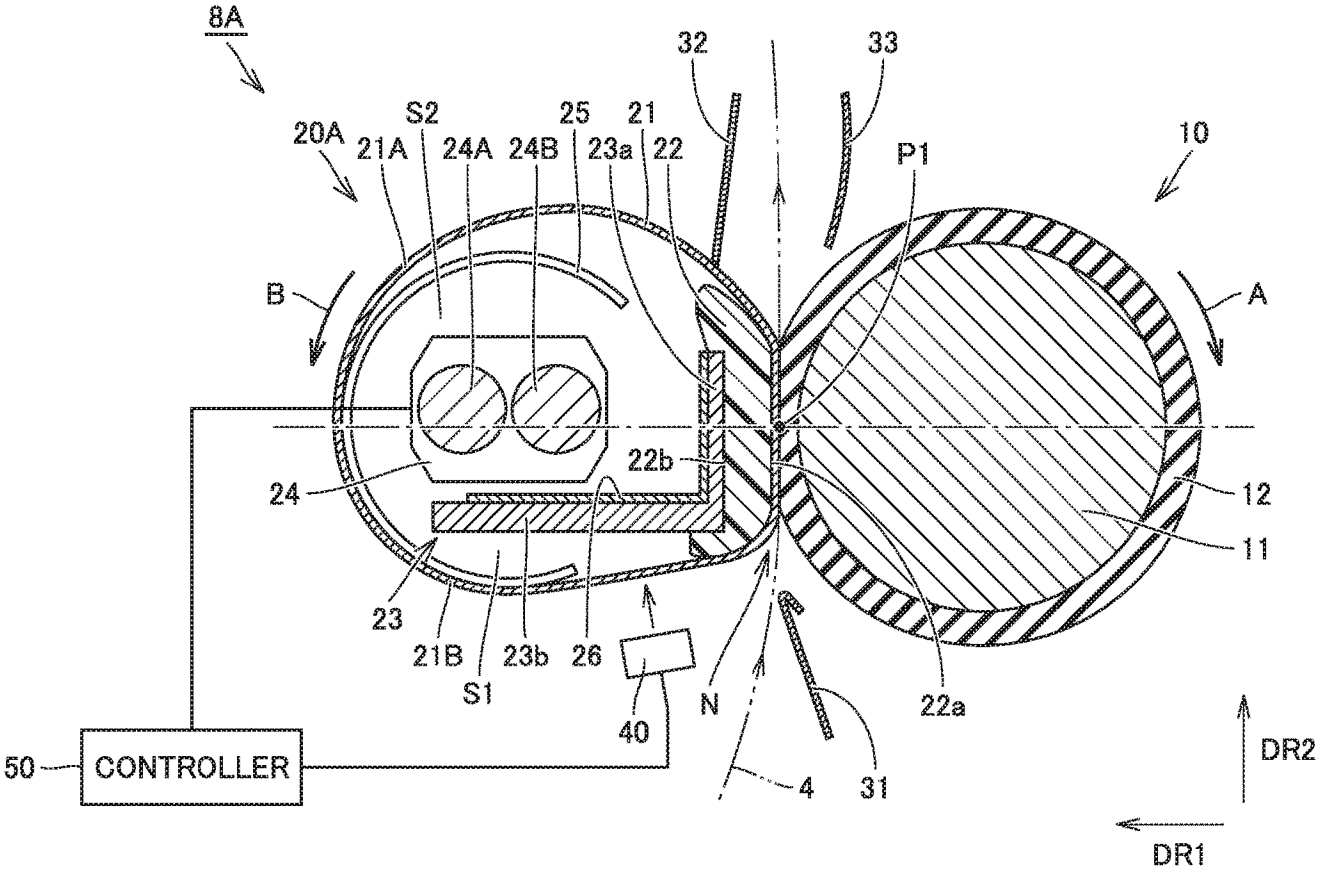
FIG. 2 is a schematic cross-sectional view of a fixing apparatus in the first embodiment.
Figure 3:
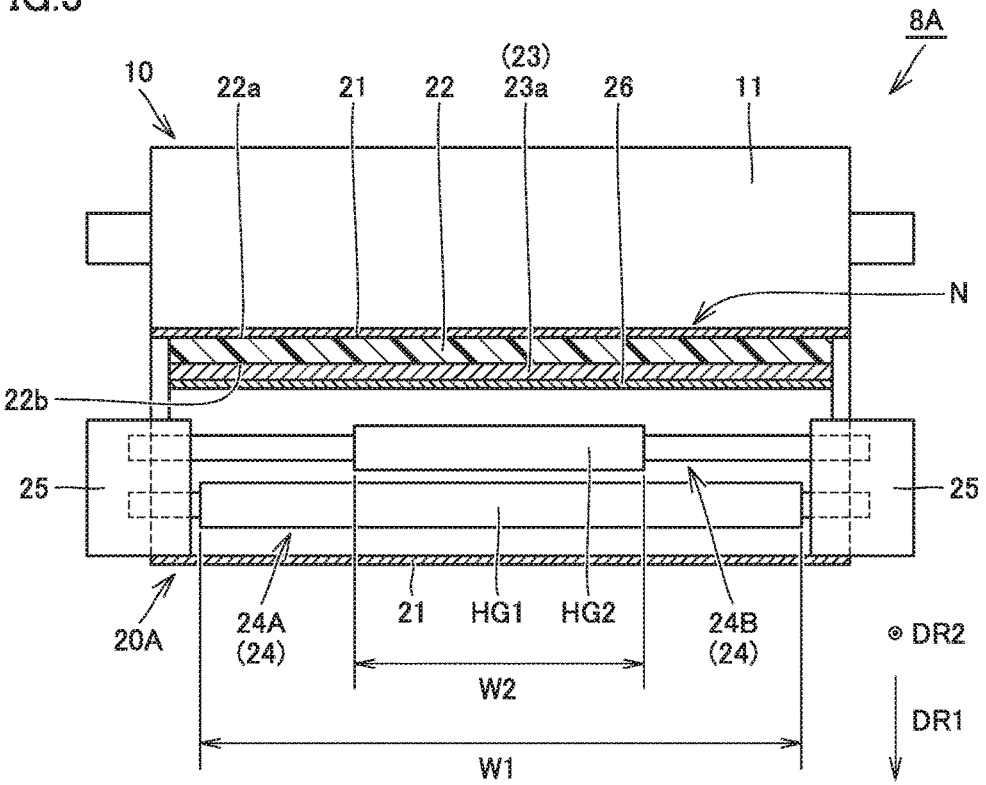
FIG. 3 is a schematic partially-cutaway plan view of the fixing apparatus shown in FIG. 2.
Figure 4:
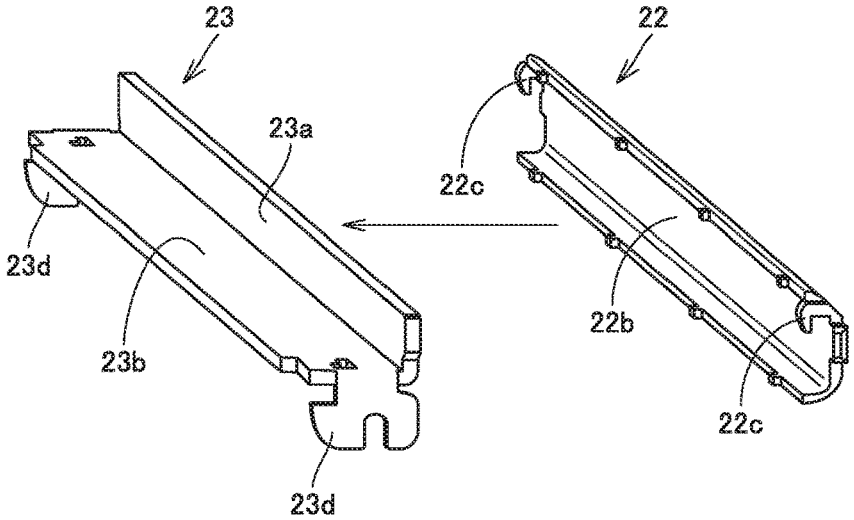
FIG. 4 is an exploded perspective view of a pad member and a supporting member shown in FIGS. 2 and 3.

FIG. 2 is a schematic cross-sectional view of the fixing apparatus in the present embodiment, and FIG. 1 is a schematic partially-cutaway plan view of the fixing apparatus shown in FIG. 2. FIG. 4 is an exploded perspective view of a pad member and a supporting member shown in FIGS. 2 and 3. Referring to FIGS. 2 to 4, a configuration of fixing apparatus 8A in the present embodiment is described.

As shown in FIGS. 2 and 3, fixing apparatus 8A mainly includes a pressing miler 10 serving as a pressing rotator, a fixing belt unit 20A serving as a heating rotator, different kinds of guides 31 to 33 for transporting a sheet of paper, a temperature sensor 40 detecting the temperature of a fixing belt 21 included in fixing belt unit 20A, and a controller 50 controlling operation of a heating source 24 included in fixing belt unit 20A.

Pressing roller 10 is formed of a metal core 11 made of aluminum alloy, for example, and a rubber elastic layer 12 made of silicone rubber, for example, and disposed to cover metal core 11. Pressing roller 10 has a diameter of 25 mm, for example. Elastic layer 12 has a thickness of 3 mm, for example. Pressing roller 10 may further have a release layer made of fluorine-based resin, for example, and covering elastic layer 12.

Pressing miler 10 is disposed to face an outer circumferential surface of fixing belt 21, and has axial opposite ends rotatably supported by a shaft-support member (not shown). Pressing roller 10 is rotatably driven by drive means such as motor (not shown). Pressing roller 10 is configured to be elastically biased toward fixing belt unit 20A by a biasing member (not shown).

Fixing belt unit 20A mainly includes a pad member 22, a supporting member 23, a pair of belt guides 25, and a high-reflectance member 26, in addition to fixing belt 21 and heating source 24 described above.

Fixing belt 21 is endless and made up of a plurality of layers, for example, in consideration of thermal resistance, strength, and surface smoothness, for example. Specifically, fixing belt 21 includes a base layer of polyimide, for example, a rubber elastic layer of silicone rubber, for example, and a release layer of fluorine-based resin, for example. These multiple layers are arranged successively in order of the base layer, the elastic layer, and the release layer in the direction from inside to outside of fixing belt 21. Fixing belt 21 has a circumferential length of 25 mm, for example. The base layer has a thickness of 60 μm, for example, the elastic layer has a thickness of 200 μm, for example, and the release layer has a thickness of 30 μm, for example.

Pad member 22 is formed of an elongate member extending in the axial direction of pressing roller 10. Pad member 22 is disposed in the space inside fixing belt 21. Pad member 22 has a substantially C-shaped cross section orthogonal to the longitudinal direction. Pad member 22 has a receiving surface 22*a* facing the inner circumferential surface of fixing belt 21, and a supported surface 22*b* located opposite to receiving surface 22*a*. Pad member 22 is made of liquid crystal polymer, for example.

Supporting member 23 is formed of an elongate member extending in die axial direction of pressing roller 10, and mostly located in the space inside fixing belt 21. Supporting member 23 is used to support pad member 22, and includes a base 23*a* in a flat plate shape and an erected wall 23*b* in a flat plate shape that are disposed in the space inside fixing belt 21. Supporting member 23 is formed of a metal member such as electrogalvanized steel sheet (SECC), for example.

As shown in FIGS. 2 to 4, in the present embodiment, erected wall 23*b* is erected from one of the ends, in the widthwise direction, of base 23*a*. The widthwise direction is orthogonal to both the longitudinal direction and the thickness direction of base 23*a*. Supporting member 23 is thus formed of a single member having an L-shaped cross section located m the space inside fixing belt 21.

As shown in FIG. 4, supporting member 23 is disposed so that one of main surfaces of base 23*a* abuts on supported surface 22*b* of pad member 22. In other words, pad member 22 and supporting member 23 are assembled so that pad member 22 covers base 23*a* of supporting member 23. More specifically, pad member 22 has, at its predetermined position, a latch portion 22*c* in the form of a hook, for example. Latch portion 22*c* is engaged with base 23*a* of supporting member 23 to fix pad member 22 to supporting member 23.

Erected wall 23*b* of supporting member 23 has opposite ends in the longitudinal direction, and a fixing portion 23*d* is located at each of these opposite ends. Fixing portions 23*d* are fixed to sidewalls of a casing forming fixing apparatus 8A, or fixed to a chassis for example disposed inside apparatus body 2 of image forming apparatus 1. Accordingly, pad member 22 is fixed in the space inside fixing belt 21.

As shown in FIGS. 2 and 3, heating source 24 includes a long heater 24A and a short heater 24B that are a pair of rod-like heaters extending in a direction parallel with the axial direction of pressing roller 10. Heating source 24 is disposed in the space inside fixing belt 21. Heating source 24 is used to heat fixing belt 21. Long heater 24A and short heater 24B are each configured as a halogen heater.

Long heater 24A has a heat generation part HG1 occupying a region corresponding to a substantially entire region of pressing roller 10 in the axial direction. Heat generation part HG1 generates heat to thereby heat fixing belt 21 mainly by means of its radiant heat. Heat generation part HG1 has an axial length (i.e., width W1 shown in FIG. 3) corresponding to the width of a sheet of paper having a maximum width among sheets of paper of different sizes to be fed to image forming apparatus 1.

Short heater 24B has a heat generation part HG2 occupying only a region corresponding to a central portion of pressing roller 10 in the axial direction. Heat generation part HG2 generates heat to thereby heat fixing belt 21 mainly by means of its radiant heat. Heat generation part HG2 has an axial length (i.e., width W2 shown in FIG. 3) corresponding to the width of a sheet of paper having a minimum width among sheets of paper of different sizes to be fed to image forming apparatus 1.

In the space inside fixing belt 21, a pair of belt guides 25 is arranged so that one belt guide 25 is located at one end of pressing roller 10 and the other belt guide 25 is located at the opposite end thereof in the axial direction. A cross-sectional shape of the pair of belt guides 25 is substantially in the shape of C. Fixing belt 21 is disposed to run slidably around the outer circumferential surface of each belt guide. The pair of belt guides 25 is fixed to sidewalls of the casing forming fixing apparatus 8A, or fixed to a chassis for example disposed inside apparatus body 2 of image forming apparatus 1. Thus, belt guides 25 guide rotation of fixing belt 21.

High-reflectance member 26 is formed of a member having a surface higher in reflectance than the surface of supporting member 23. High-reflectance member 26 is formed of a reflecting plate made of aluminum, for example. High-reflectance member 26 is used to reflect light radiated from heating source 24 toward fixing belt 21. High-reflectance member 26 enables fixing belt 21 to be heated more efficiently. High-reflectance member 26 is fixed to a predetermined location of the surface of supporting member 23 by means of adhesion or screw(s), for example.

Pressing miler 10 is configured to be elastically biased toward fixing belt unit 20A by a biasing member (not shown), as described above. As shown in FIGS. 2 and 3, with pressing roller 10 elastically biased toward fixing belt unit 20A by a biasing member (not shown), fixing belt 21 is pressed against receiving surface 22*a* of pad member 22.

With fixing bell 21 pressed against receiving surface 22*a* of pad member 22, pressing roller 10 is rotationally driven in the direction indicated by an arrow A in FIG. 2, by drive means such as motor (not shown) as described above. Accordingly, fixing belt 21 is rotated in the direction indicated by an arrow B shown in FIG. 2 while sliding on receiving surface 22*a* of pad member 22, following rotation of pressing roller 10.

A nip portion N is thus formed between pressing roller 10 and the outer circumferential surface of fixing belt 21. A sheet of paper is transported through nip portion N. In other words, pressing roller 10 and fixing belt unit 20A are arranged with paper transport path 4 between roller 10 and fixing belt unit 20A, so that nip portion N formed therebetween is located on transport path 4.

As shown in FIGS. 2 and 3, with fixing belt 21 pressed against receiving surface 22*a* of pad member 22, pressing roller 10 and fixing belt unit 20A are arranged in a pressing direction DR1. In pressing direction DR1, fixing belt 21 is pressed against receiving surface 22*a* of pad member 22. A direction orthogonal to pressing direction DR1 and orthogonal to the axial direction of pressing roller 10 is a transport direction DR2 in which a sheet of paper is transported.

An entrance guide 31 is disposed at a position on transport path 4. Entrance guide 31 is located upstream of nip portion N (i.e., located lower than nip portion N in FIG. 2) in paper transport direction DR2. Entrance guide 31 serves as a guide for reliably causing a sheet of paper transported along transport path 4 to enter nip portion N.

A separation guide 32 and an exit guide 33 are also disposed at respective positions on transport path 4. Separation guide 32 and exit guide 33 are located downstream of nip portion N (i.e., located higher than nip portion N in FIG. 2) in paper transport direction DR2. Separation guide 32 serves as a guide for causing a sheet of paper in close contact with fixing belt 21 to be separated from fixing belt 21 when the sheet of paper is discharged from nip portion N. Exit guide 33 serves as a guide for causing the sheet of paper separated from fixing belt 21 by separation guide 32 to reliably return onto transport path 4.

As shown in FIG. 2, temperature sensor 40 is disposed to face the outer circumferential surface of fixing belt 21, and located upstream of nip portion N in the rotational direction of fixing belt 21. Temperature sensor 40 is configured as a non-contact sensor capable of measuring the temperature of fixing belt 21 without contacting fixing belt 21, for example.

Based on the temperature detected by temperature sensor 40, controller 50 controls operation of heating source 24 made up of long heater 24A and short heater 24B to adjust the temperature of fixing belt 21 so that it falls in a predetermined temperature range (150° C. or more and 180° C. or less, for example) when fixing belt 21 passes through nip portion N.

As shown in FIG. 2, in fixing apparatus SA in the present embodiment, erected wall 23*b* of supporting member 23 is disposed upstream in paper transport direction DR2, from an intermediate position (position indicated by reference P1 in the drawing) of nip portion N in paper transport direction DR2, and erected wall 23*b* is formed to be erected from base 23*a* in a direction away from the position of pressing roller 10.

Erected wall 23*b* is formed to be relatively long. Specifically, the length of erected wall 23*b* in the direction in which erected wall 23*b* is erected (i.e., the direction parallel with pressing direction DR1) is larger than a predetermined size (approximately a half or more of the diameter of fixing belt 21, for example). Accordingly, the space inside fixing belt 21 is substantially partitioned by erected wall 23*b* into an upstream space S1 located upstream in paper transport direction DR2 and a downstream space S2 located downstream in paper transport direction DR2.

As described above, erected wall 23*b* is disposed upstream in paper transport direction DR2, from the intermediate position of nip portion N indicated by reference P1. Therefore, downstream space S2 is a larger space than upstream space S1. Heating source 24 is disposed in downstream space S2 which is the larger space.

This configuration increases the efficiency of space usage, relative to a configuration where the space inside the fixing belt is partitioned by the supporting member into two spaces that are substantially equal to each other, and thereby enables downsizing of fixing belt unit 20A as a whole. It is therefore possible to heat fixing belt 21 with less thermal energy. As the surface area of fixing belt 21 is reduced, useless heat dissipation can be prevented. This configuration can be used to produce a compact fixing apparatus appropriate for energy saving.

In fixing apparatus 8A in the present embodiment, long heater 24A and short heater 24B are arranged in pressing direction DR1. This configuration enables increase of the efficiency of space usage, relative to the case where other layouts of heating source 24 are used, and thereby enables a compact fixing apparatus appropriate for energy saving to be produced.

In fixing apparatus 8A in the present embodiment, long heater 24A is located at a distance from pressing roller 10 longer than the distance from pressing roller 10 to short heater 24B. In such a configuration, long heater 24A used relatively more frequently in a normal state of use is located at a distance from fixing belt 21 shorter than the distance from fixing belt 21 to short heater 24B used relatively less frequently. Radiant heat generated by heating source 24 can be used efficiently for heating fixing belt 21. Thus, the fixing apparatus appropriate for energy saving can be produced.

In fixing apparatus 8A in the present embodiment, high-reflectance member 26 is attached to substantially the whole of the surface, facing heating source 24, of base 23*a* and erected wall 23*b* of supporting member 23. This configuration enables efficient reflection, toward fixing belt 21, of light radiated from heating source 24. A fixing apparatus appropriate for energy saving can thus be produced.

In the present embodiment, high-reflectance member 26 is attached to supporting member 23. Alternatively, the surface of supporting member 23 may be plated in such a manner that a part of the surface of supporting member 23 is a high-reflectance surface higher in reflectance than the remaining part of the surface of supporting member 23. This configuration also enables efficient reflection, toward fixing belt 21, of light radiated from heating source 24. A fixing apparatus appropriate for energy saving can thus be produced.

The position where high-reflectance member 26 is attached and the position where the high-reflectance surface is formed are not particularly limited. This position may be the whole or a part of the surface of base 23*a* facing heating source 24, or the whole or a part of the surface of erected wall 23*b* facing heating source 24, besides the above-described positions. High-reflectance member 26 may be additionally attached to the whole or a part of the surface, failing to face heating source 24, of base 23*a* and erected wall 23*b*, or the whole or a part of the surface, failing to face heating source 24, of base 23*a* and erected wall 23*b* may be additionally formed as a high-reflectance surface.

In fixing apparatus 8A in the present embodiment, supporting member 23 has an L-shaped cross section extending continuously from one end of base 23*a* in paper transport direction DR2 to one end of erected wall 23*b* in pressing direction DR1. This configuration enables supporting member 23 to be formed easily by bending a flat metal sheet, for example, which produces the effect of reducing the manufacture cost.

In fixing apparatus 8A in the present embodiment, supporting member 23 is formed of a single member. This configuration enables reduction of the number of parts and facilitates assembly work, which also produces the effect of reducing the manufacture cost.

Figure 5:
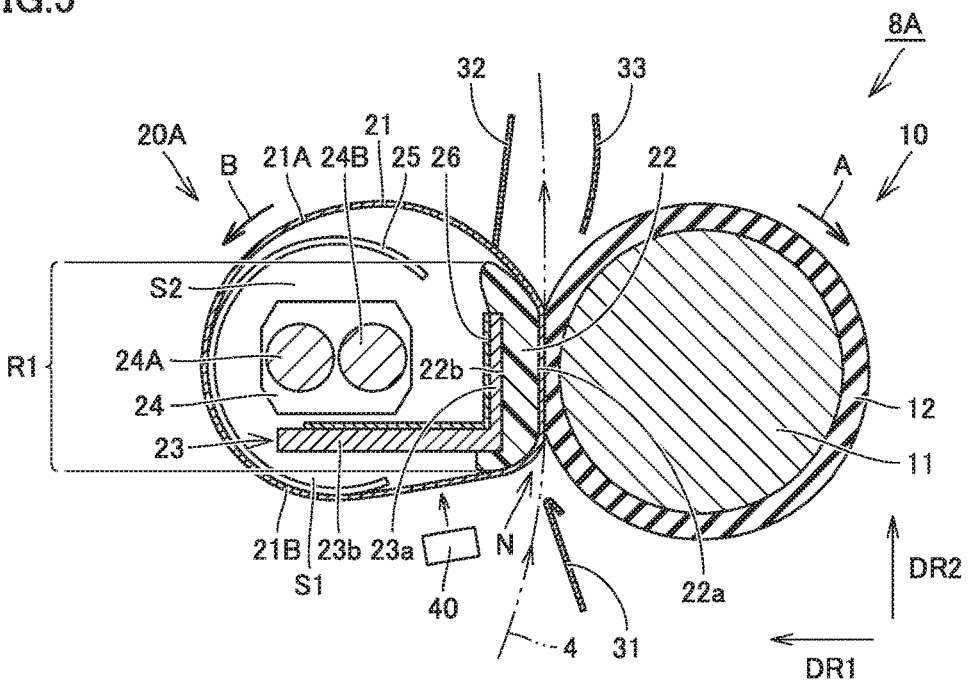
FIG. 5 is a diagram for illustrating an additional feature of a configuration of the fixing apparatus shown in FIG. 2.
Figure 6:
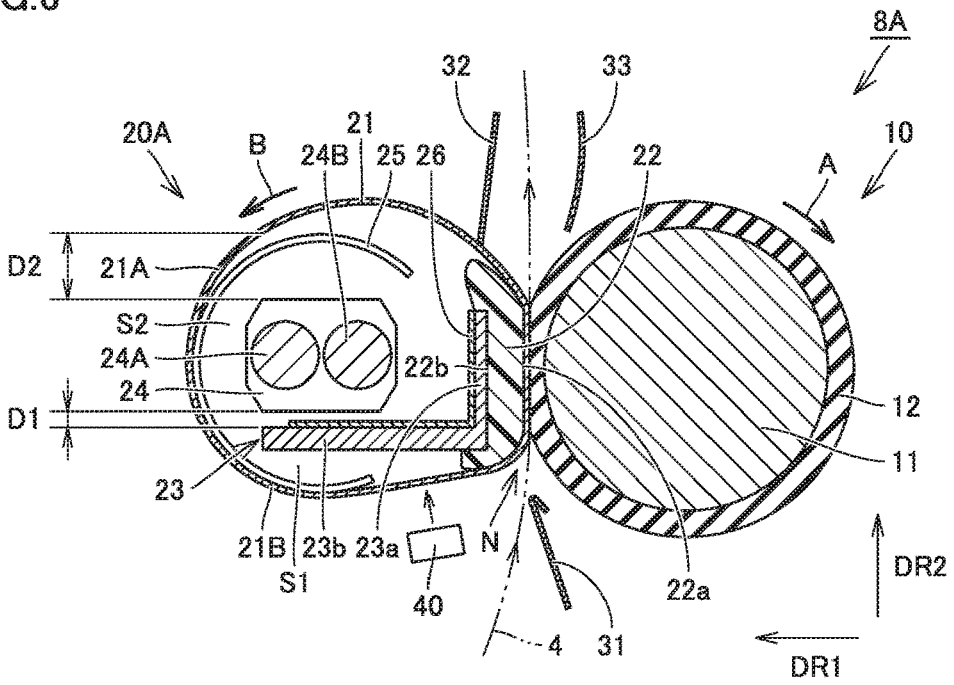
FIG. 6 is a diagram for illustrating another additional feature of the configuration of the fixing apparatus shown in FIG. 2.
Figure 7:
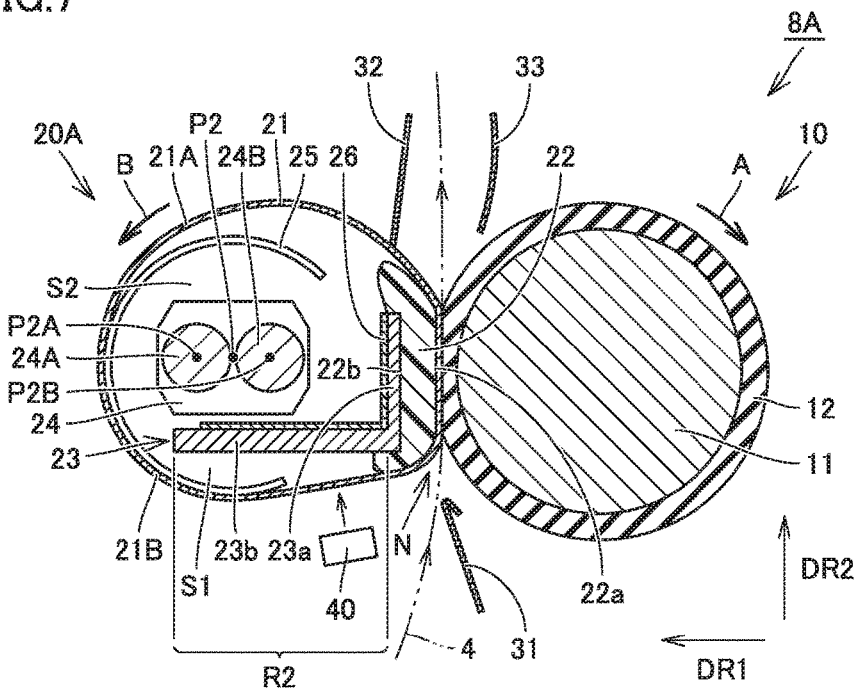
FIG. 7 is a diagram for illustrating still another additional feature of the configuration of the fixing apparatus shown in FIG. 2.

FIGS. 5 to 7 each illustrate an additional feature of the configuration of the fixing apparatus shown in FIG. 2. In the following, features of the configuration of fixing apparatus 8A in the present embodiment, specifically additional features to be particularly mentioned in addition to those described above, are described in detail with reference to FIGS. 5 to 7 and FIG. 2.

Referring to FIGS. 2 and 5 to 7, "first specific portion 21A" and "second specific portion 21B" are defined for the sake of convenience of description. "First specific portion 21A" is a portion of fixing belt 21, the portion defines a space where heating source 24 is disposed, and the space is one of the spaces into which the space inside the fixing belt 21 is partitioned by erected wall 23*b* of supporting member 23. "Second specific portion 21B" is a portion of fixing belt 21, and the portion defines upstream space S1. In the present embodiment, heating source 24 is disposed in downstream space S2. First specific portion 21A and second specific portion 21B are therefore different portions of fixing belt 21.

In the fixing apparatus for which the fixing belt is used, as the fixing belt rotates following rotation of the pressing roller, an upstream portion of the fixing belt in the paper transport direction (i.e., a portion to be introduced into the nip portion) is drawn strongly by the pressing roller. Consequently, this portion becomes a pulled state (tense state).

Thus, in fixing apparatus 8A in the present embodiment as well, as fixing belt 21 rotates following rotation of the pressing roller, the portion of fixing belt 21 to be introduced into nip portion N (i.e., particularly a downstream part of second specific portion 21B in the rotational direction of fixing belt 21) is in a tense state.

In contrast, in the fixing apparatus for which the fixing belt is used, as the fixing belt rotates following rotation of the pressing roller, a downstream portion of the fixing belt in the paper transport direction (i.e., a portion ejected from the nip portion) is pushed out by the pressing roller. Consequently, this portion becomes a sagged state (loose state). Thus, in fixing apparatus 8A in the present embodiment as well, as fixing belt 21 rotates following rotation of the pressing roller, the portion of fixing belt 21 ejected from nip portion N (i.e., particularly an upstream part of first specific portion 21A in the rotational direction of fixing belt 21) is in a loose state.

Accordingly, in fixing apparatus 8A in the present embodiment, as fixing belt 21 rotates following rotation of the pressing roller, the trajectory of second specific portion 21B of fixing belt 21 is relatively stable. In contrast, the trajectory of first specific portion 21A of fixing belt 21 is unstable and tends to flap.

As shown in FIG. 5, in fixing apparatus 8A in the present embodiment heating source 24 is disposed between the opposite ends of pad member 22 in paper transport direction DR2, as seen in pressing direction DR1. In other words, heating source 24 is configured to be located within a region R1 shown in FIG. 12.

This configuration enables a sufficient distance between heating source 24 and first specific portion 21A of fixing belt 21 to be ensured. Therefore, even when first specific portion 21A of fixing belt 21 flaps, first specific portion 21A can be prevented from contacting or approaching heating source 24. Failure of fixing belt 21 due to excessive heating can thus be prevented.

As shown in FIG. 6, fixing apparatus 8A in the present embodiment is configured so that a distance D1 between heating source 24 and erected wall 23*b* of supporting member 21 in paper transport direction DR2 is smaller than a distance D2 between heating source 24 and first specific portion 21A of fixing belt 21 in paper transport direction DR2.

This configuration enables a sufficient distance between heating source 24 and first specific portion 21A of fixing belt 21 to be ensured. Therefore, even when first specific portion 21A of fixing belt 21 flaps, first specific portion 21A can be prevented from contacting or approaching heating source 24. Failure of fixing belt 21 due to excessive heating can thus be prevented.

As shown in FIG. 7, in fixing apparatus 8A in the present embodiment a center position (position indicated by reference P2 in the drawing) of heating source 24 in pressing direction DR1 is located between the opposite ends of erected wall 23*b* of supporting member 23 in pressing direction DR1, as seen in paper transport direction DR2. In other words, the center position of heating source 24 indicated by reference P2 is located within a region R2 shown in FIG. 7.

More specifically, in fixing apparatus 8A in the present embodiment, the center position (position indicated by reference P2A in the drawing) of long heater 24A in pressing direction DR1 and the center position (position indicated by reference P2B in the drawing) of short heater 24B in pressing direction DR1 are both located between the opposite ends of erected wall 23*b* of supporting member 23 in pressing direction DR1, as seen in paper transport direction DR2. Namely, the center position of long heater 24A indicated by reference P2A and the center position of short heater 24B indicated by reference P2B are located within region R2 shown in FIG. 7.

This configuration enables increase of the efficiency of space usage, relative to the case where other layouts of heating source 24 are used, and thereby enables a compact fixing apparatus appropriate for energy saving to be produced. Moreover, light radiated from heating source 24 can be reflected highly efficiently by the surface of supporting member 23 or by high-reflectance member 26 attached to the surface of supporting member 23. This light can be used efficiently for heating fixing belt 21. A fixing apparatus appropriate for energy saving can thus be produced.

Referring to FIG. 2, in fixing apparatus 8A in the present embodiment, temperature sensor 40 is located upstream of nip portion N in the rotational direction of fixing belt 21, as described above. More specifically, temperature sensor 40 is located to face the outer circumferential surface of second specific portion 21B of fixing belt 21 for detecting the temperature of second specific portion 21B.

In this configuration, the temperature of fixing belt 21 detected by temperature sensor 40 is not the temperature of the portion of fixing belt 21 directly heated by heating source 24 but the portion thereof that is not directly heated by heating source 24 (i.e., the portion whose temperature is relatively stable) because shielded by erected wall 23*b* of supporting member 23.

As compared with a configuration where the temperature sensor detects the portion of the fixing belt that is directly heated by the heating source, an error of the measured temperature due to low accuracy of the positioning of temperature sensor 40, for example, can be eliminated effectively. The temperature of fixing belt 21 at nip portion N can be adjusted to fall within a predetermined temperature range with high controllability. This configuration can therefore be used to produce a fixing apparatus capable of causing a toner image formed on a sheet of paper to be fixed precisely and stably to the paper.

In view of the above, it is preferable to suppress increase of the temperature of erected wall 23*b* so as to suppress undesired heating of second specific portion 21B of fixing belt 21 through supporting member 23, due to increase of the temperature of supporting member 23 resultant from heating of erected wall 23*b* of supporting member 23 by heating source 24. It is therefore preferable that the position where high-reflectance member 26 is attached and the position where a high-reflectance surface is formed should include at least the whole or a part of the surface of erected wall 23*b* of supporting member 23 that faces heating source 24, in order to suppress increase of the temperature of erected wall 23*b*.

As seen from the foregoing, fixing apparatus 8A in the present embodiment and image forming apparatus 1 including this fixing apparatus can be implemented as a compact fixing apparatus appropriate for energy saving and an image forming apparatus including this fixing apparatus.

Second Embodiment

Figure 8:
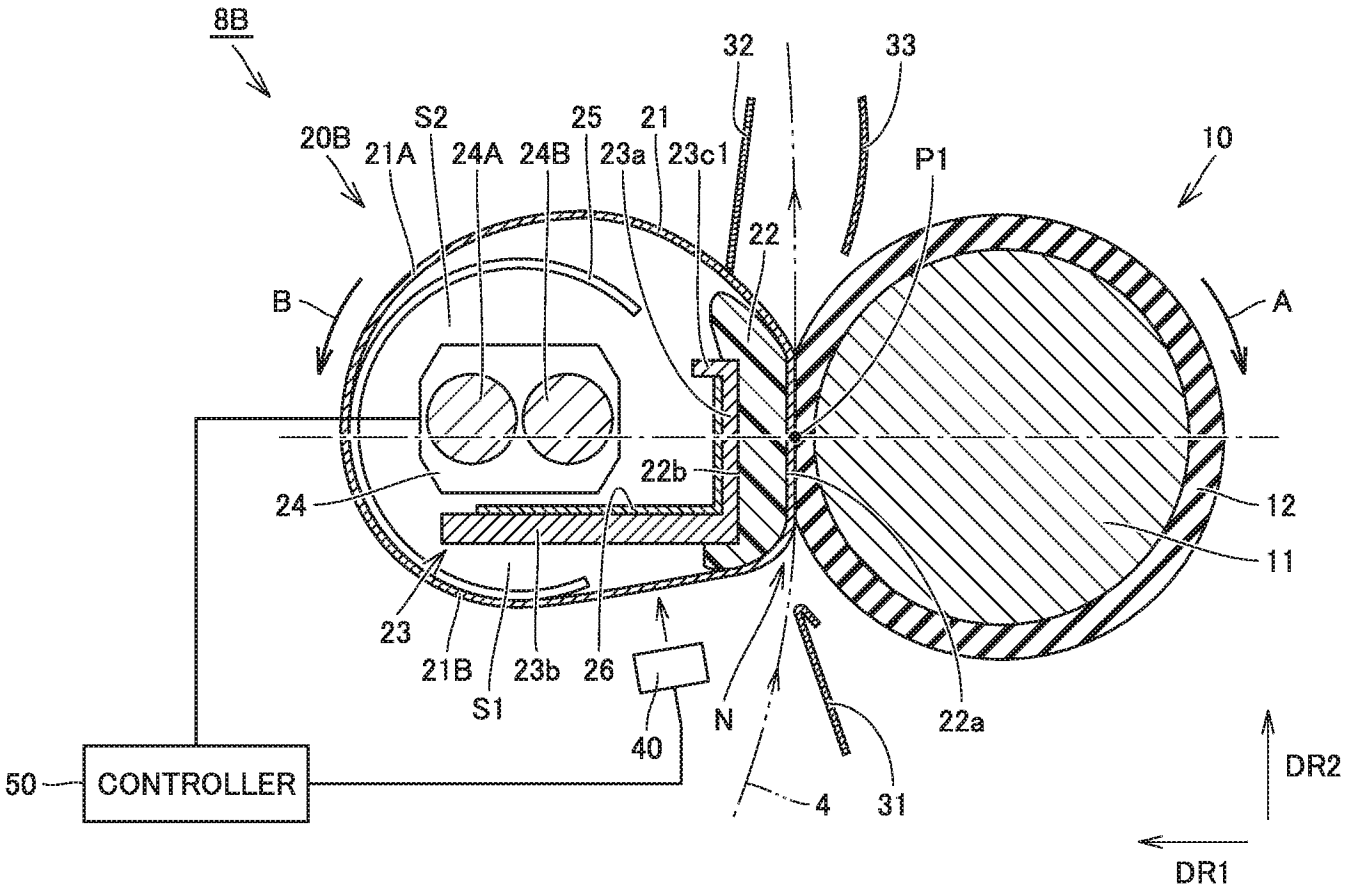
FIG. 8 is a schematic cross-sectional view of a fixing apparatus in a second embodiment.

FIG. 8 is a schematic cross-sectional view of a fixing apparatus in the second embodiment. In the following, fixing apparatus 8B in the present embodiment is described with reference to FIG. 8. Fixing apparatus 8B in the present embodiment is to be incorporated in image forming apparatus 1 in the first embodiment, instead of fixing apparatus SA in the first embodiment.

As shown in FIG. 8, fixing apparatus SB in the present embodiment differs from fixing apparatus SA in the first embodiment only in that the former includes a fixing belt unit 20B including a supporting member 23 having a different shape. Specifically, supporting member 23 includes a reinforcing auxiliary wall 23*c*1 in addition to base 23*a* and erected wall 23*b*.

Reinforcing auxiliary wall 23*c*1 is erected from an end. This end is one of the pair of ends of base 23*a* in the paper transport direction, and different from the end from which erected wall 23*b* extends. More specifically, reinforcing auxiliary wall 23*c*1 is formed to protrude from base 23*a* in a direction away from the position of pressing roller 10.

Reinforcing auxiliary wall 23*c*1 is configured to have a length in the erecting direction (i.e., direction parallel with pressing direction DR1) sufficiently smaller than the length of erected wall 23*b* in the erecting direction (i.e., direction parallel with pressing direction DR1). Reinforcing auxiliary wall 23*c*1 is thus configured so as not to interfere with heating source 24 disposed in downstream space S2.

Supporting member 23 thus includes reinforcing auxiliary wall 23*c*1 erected from base 23*a* in addition to base 23*a* and erected wall 23*b*, which significantly increases the rigidity of supporting member 23.

Fixing apparatus 8B having the above-described configuration and image forming apparatus 1 including this fixing apparatus provide the effects described in connection with the first embodiment, and further provide the effect that undesired deformation of supporting member 23 due to the pressing force applied by pressing roller 10 can be prevented more reliably.

This configuration enables easy formation of supporting member 23 by bending a flat metal sheet, for example, which produces the effect that the manufacture cost can be reduced, and also enables supporting member 23 to be formed of a single member, which also produces the effect that the manufacture cost can be reduced.

Third Embodiment

Figure 9:
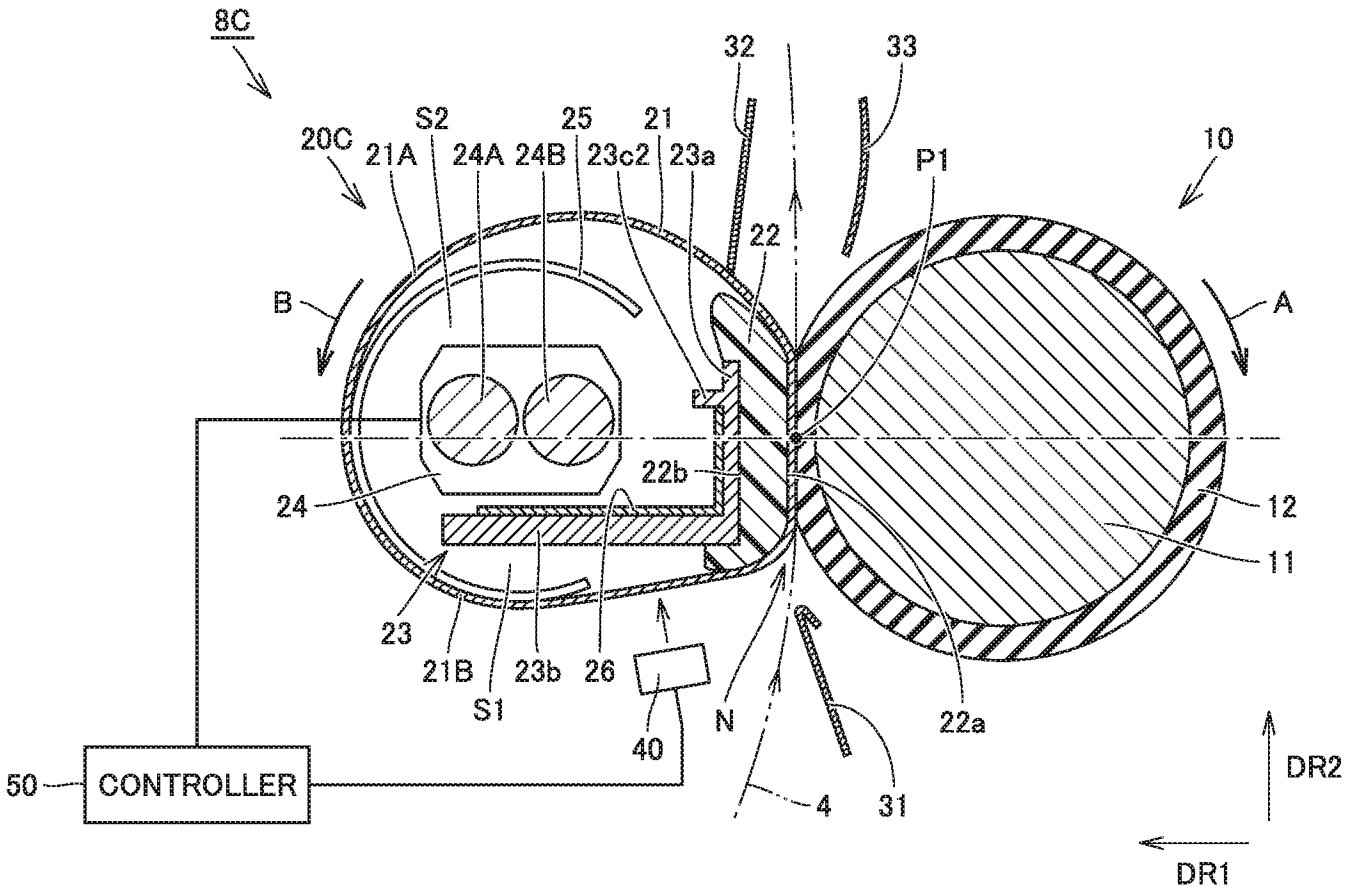
FIG. 9 is a schematic cross-sectional view of a fixing apparatus in a third embodiment.

FIG. 9 is a schematic cross-sectional view of a fixing apparatus in the third embodiment. In the following, fixing apparatus 8C in the present embodiment is described with reference to FIG. 9. Fixing apparatus 8C in the present embodiment is to be incorporated in image forming apparatus 1 in the first embodiment, instead of fixing apparatus 8A in the first embodiment.

As shown in FIG. 9, fixing apparatus 8C in the present embodiment differs from fixing apparatus 8A in the first embodiment only in that the former includes a fixing belt unit 20C including a supporting member 23 having a different shape. Specifically, supporting member 23 includes a reinforcing auxiliary wall 23*c*2 in addition to base 23*a* and erected wall 23*b*.

Reinforcing auxiliary wall 23*c*2 is erected from a position of base 23*a*. This position is any position between a pair of ends of base 23*a* in the paper transport direction, but other than the pair of ends of base 23*a*. More specifically, reinforcing auxiliary wall 23*c*2 is formed to protrude from base 23*a* in a direction away from the position of pressing roller 10.

Reinforcing auxiliary wall 23*c*2 is configured to have a length in the erecting direction (i.e., direction parallel with pressing direction DR1) sufficiently smaller than the length of erected wall 23*b* in the erecting direction (i.e., direction parallel with pressing direction DR1). Reinforcing auxiliary wall 23*c*2 is thus configured so as not to interfere with heating source 24 disposed in downstream space S2.

Supporting member 23 thus includes reinforcing auxiliary wall 23*c*2 erected from base 23*a* in addition to base 23*a* and erected wall 23*b*, which significantly increases the rigidity of supporting member 23.

Fixing apparatus 8C having the above-described configuration and image forming apparatus 1 including this fixing apparatus provide the effects described in connection with the first embodiment, and further provide the effect that undesired deformation of supporting member 23 due to the pressing force applied by pressing roller 10 can be prevented more reliably.

This configuration enables supporting member 23 to be formed of a single member, which produces the effect that the manufacture cost can be reduced.

Fourth Embodiment

Figure 10:
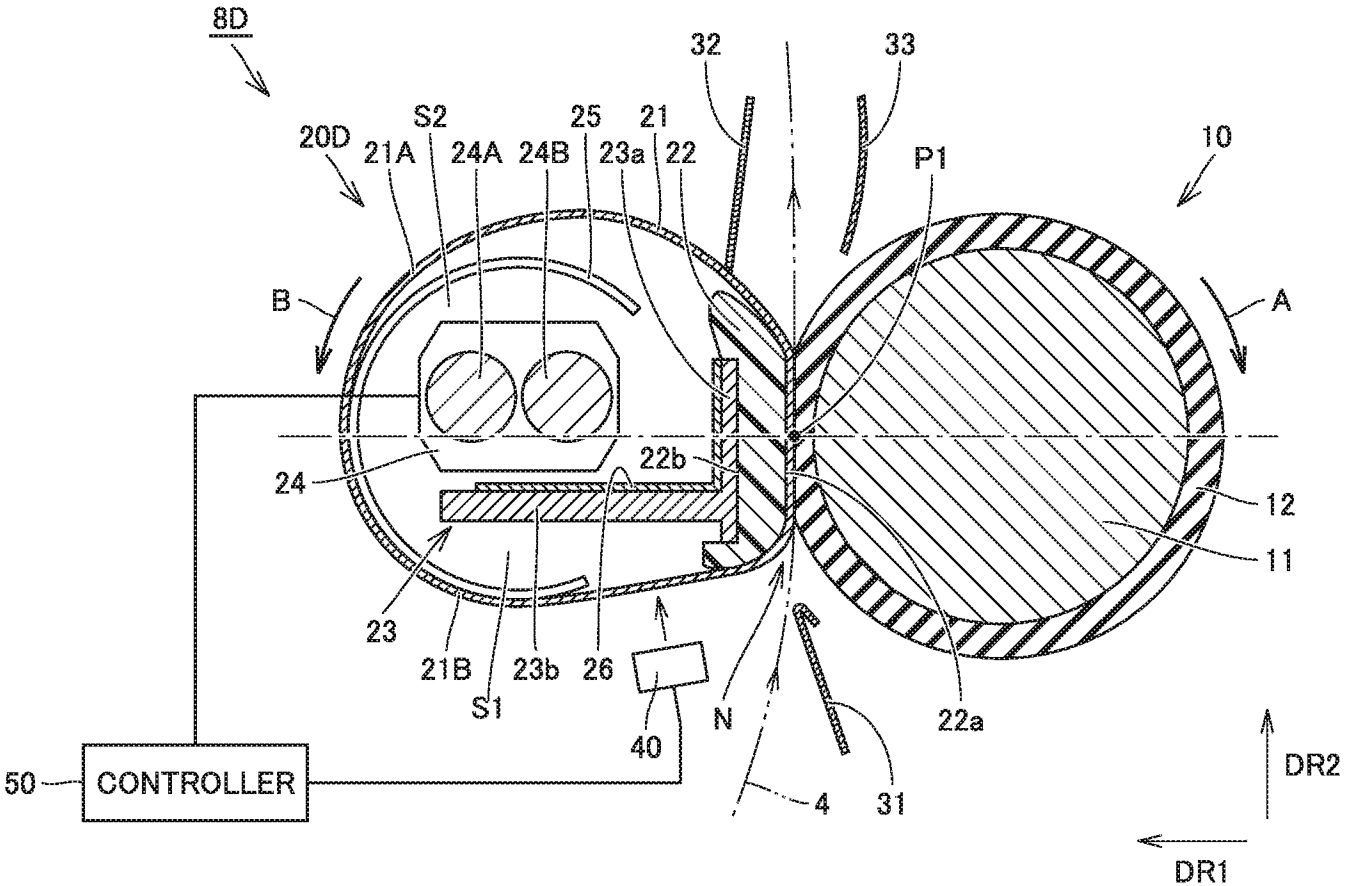
FIG. 10 is a schematic cross-sectional view of a fixing apparatus in a fourth embodiment.

FIG. 10 is a schematic cross-sectional view of a fixing apparatus in the fourth embodiment. In the following, fixing apparatus 8D in the present embodiment is described with reference to FIG. 10. Fixing apparatus 8D in the present embodiment is to be incorporated in image forming apparatus 1 in the first embodiment, instead of fixing apparatus 8A in the first embodiment.

As shown in FIG. 10, fixing apparatus 8D in the present embodiment differs from fixing apparatus 8A in the first embodiment only in that the former includes a fixing belt unit 20D including a supporting member 23 having a different shape. Specifically, fixing belt unit 20D differs from the above-described one in the position where erected wall 23*b* of supporting member 23 is formed on base 23*a*.

More specifically, erected wall 23*b* is erected from a position of base 23*a*. This position is any position between a pair of ends of base 23*a* in the paper transport direction, but other than the pair of ends of base 23*a*. Erected wall 23*b* is formed to be erected from base 23*a* in the direction away from the position of pressing roller 10.

In the present embodiment as well, erected wall 23*b* is disposed upstream in paper transport direction DR2, from the intermediate position of nip portion N indicated by reference P1. Downstream space S2 is therefore a larger space than upstream space S1. Heating source 24 is disposed in downstream space S2 which is the larger space.

Fixing apparatus 8D having the above-described configuration and image forming apparatus 1 including this fixing apparatus provide the effects described in connection with the first embodiment. A compact fixing apparatus appropriate for energy saving and an image forming apparatus including the fixing apparatus can thus be implemented.

This configuration also enables supporting member 23 to be formed of a single member, which produces the effect that the manufacture cost can be reduced.

Fifth Embodiment

Figure 11:
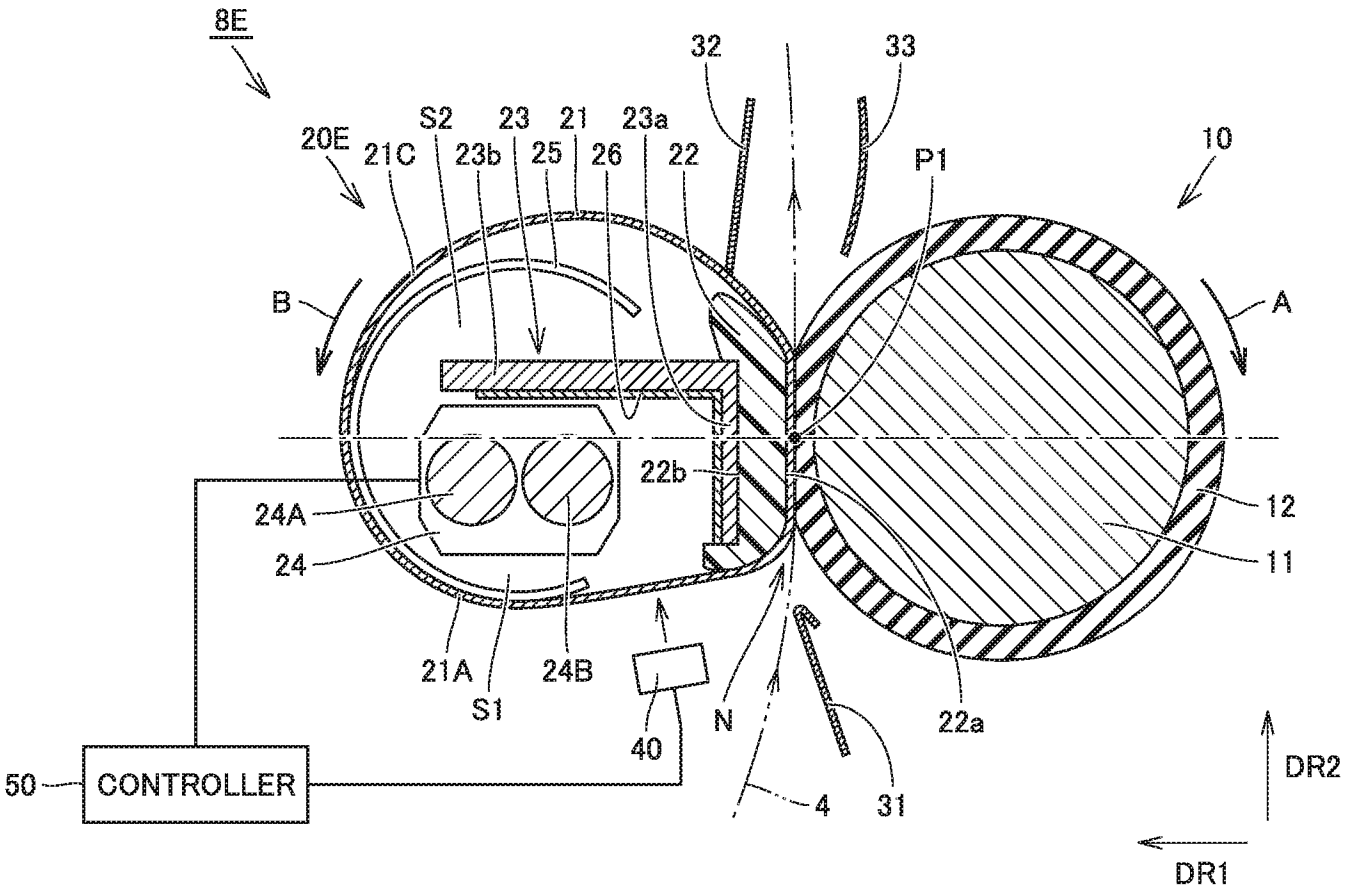
FIG. 11 is a schematic cross-sectional view of a fixing apparatus in a fifth embodiment.

FIG. 11 is a schematic cross-sectional view of a fixing apparatus in the fifth embodiment. In the following, fixing apparatus 8E in the present embodiment is described with reference to FIG. 11. Fixing apparatus 8E in the present embodiment is to be incorporated m image forming apparatus 1 in the first embodiment, instead of fixing apparatus 8A in the first embodiment.

As shown in FIG. 11, fixing apparatus SE in the present embodiment differs from fixing apparatus 8A in the first embodiment in that a fixing belt unit 20E of the former includes a supporting member 23 having a different shape and a heating source 24 disposed at a different position.

Specifically, erected wall 23*b* of supporting member 23 is disposed downstream in paper transport direction DR2, from the intermediate position (position indicated by reference P1 in the drawing) of nip portion N in paper transport direction DR2, and erected wall 23*b* is formed to be erected from base 23*a* in the direction away from the position of pressing roller 10.

Erected wall 23*b* is formed to be relatively long. Specifically, the length of erected wall 23*b* in the direction in which erected wall 23*b* is erected (i.e., the direction parallel with pressing direction DR1) is larger than a predetermined size (approximately a half or more of the diameter of fixing belt 21, for example). Accordingly, the space inside fixing belt 21 is substantially partitioned by erected wall 23*b* into an upstream space S1 located upstream in paper transport direction DR2 and a downstream space S2 located downstream in paper transport direction DR2.

As described above, erected wall 23*b* is disposed downstream in paper transport direction DR2, from the intermediate position of nip portion N indicated by reference P1. Therefore, upstream space S1 is a larger space than downstream space S2. Heating source 24 is disposed in upstream space S1 which is the larger space.

This configuration increases the efficiency of space usage, relative to a configuration where the space inside the fixing belt is partitioned by the supporting member into two spaces that are substantially equal to each other, and thereby enables downsizing of fixing belt unit 20E as a whole. It is therefore possible to heat fixing belt 21 with less thermal energy. As the surface area of fixing apparatus 21 is reduced, useless heat dissipation can be prevented. This configuration can be used to produce a compact fixing apparatus appropriate for energy saving.

This configuration enables supporting member 23 to be formed easily by bending a flat metal sheet, for example, which produces the effect that the manufacture cost can be reduced. Supporting member 23 can be formed of a single member, which also provides the effect that the manufacture cost can be reduced.

Figure 12:
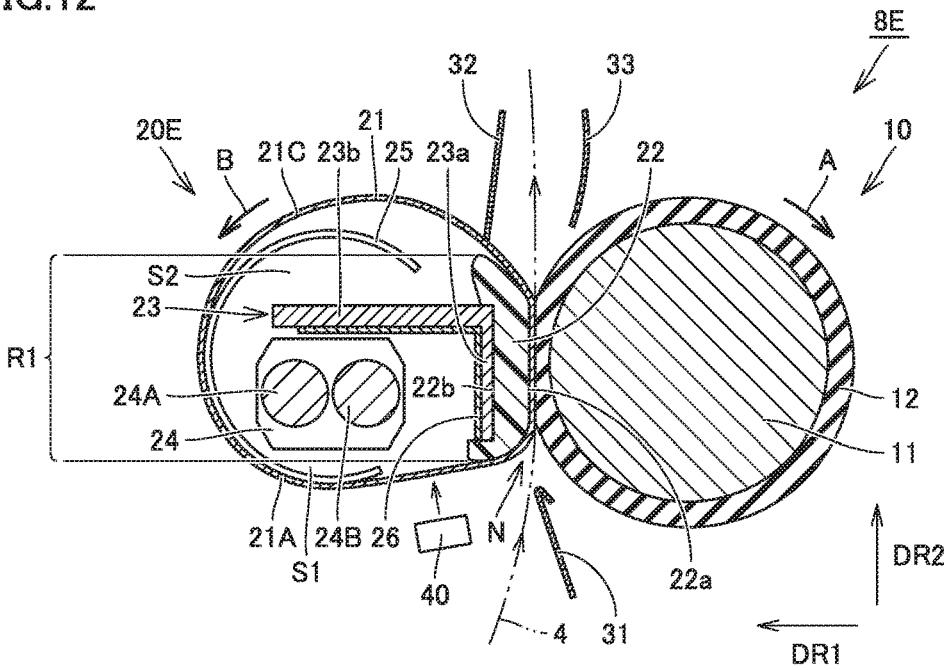
FIG. 12 is a diagram for illustrating an additional feature of a configuration of the fixing apparatus shown in FIG. 11.
Figure 13:
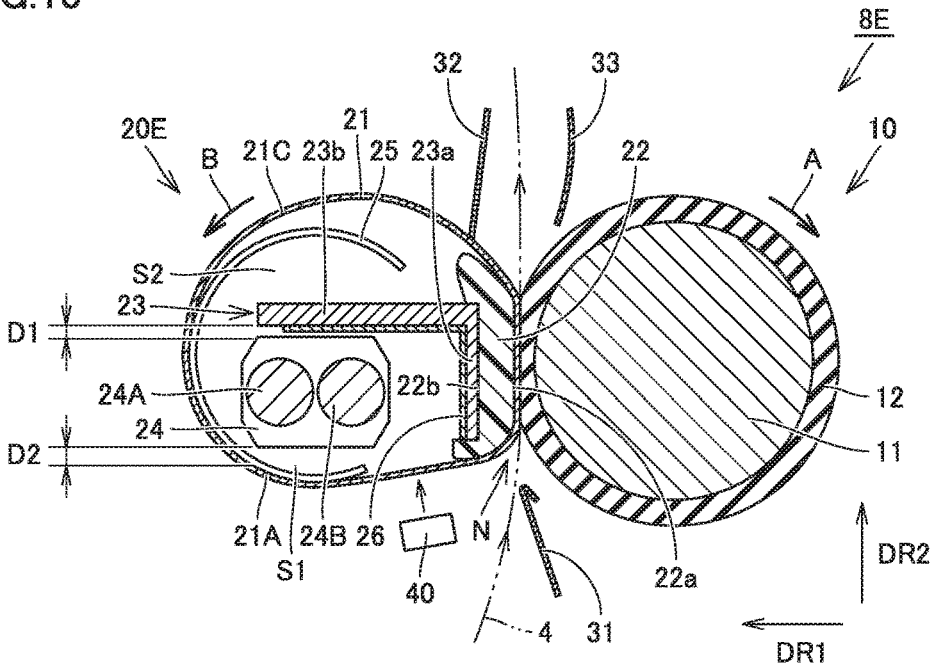
FIG. 13 is a diagram for illustrating another additional feature of the configuration of the fixing apparatus shown in FIG. 11.
Figure 14:
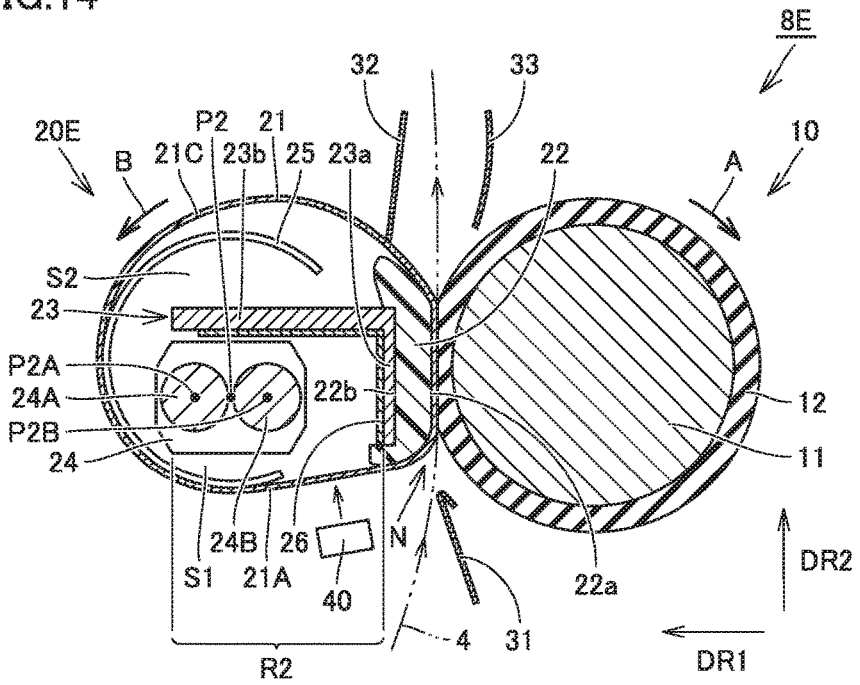
FIG. 14 is a diagram for illustrating still another additional feature of the configuration of the fixing apparatus shown in FIG. 11.

FIGS. 12 to 14 each illustrate an additional feature of the configuration of the fixing apparatus shown in FIG. 11. In the following, features of the configuration of fixing apparatus 8E in the present embodiment, specifically additional features to be particularly mentioned in addition to those described above, are described in detail with reference to FIGS. 12 to 14 and FIG. 11.

Referring to FIGS. 11 to 14, like the first embodiment described above. "first specific portion 21A" and "second specific portion 21B" are defined in the following way. "First specific portion" is a portion of fixing belt 21 defining the space where heating source 24 is disposed, of the inner space of fixing belt 21 partitioned by erected wall 23*b* of supporting member 23, and "second specific portion 21B" is a portion of fixing belt 21 defining upstream space S1. In fixing apparatus 8E in the present embodiment, heating source 24 is disposed in upstream space S1, and therefore, above-defined first specific portion 21A and second specific portion 21B refer to the same portion of fixing belt 21. Therefore, for the sake of convenience, this portion of fixing belt 21 is referred to as first specific portion 21A only. In the present embodiment, the portion of fixing belt 21 defining downstream space S2 is defined as "third specific portion 21C."

In this case, in fixing apparatus 8E in the present embodiment, as fixing belt 21 rotates following rotation of the pressing roller, the trajectory of first specific portion 21A of fixing belt 21 is relatively stable. In contrast, the trajectory of third specific portion 21C of fixing belt 21 is unstable and tends to flap.

As shown in FIG. 11, in fixing apparatus SE in the present embodiment, heating source 24 is disposed between the opposite ends of pad member 22 in paper transport direction DR2, as seen in pressing direction DR1. In other words, heating source 24 is configured to be located within a region R1 shown in FIG. 12.

This configuration enables a sufficient distance between heating source 24 and first specific portion 21A of fixing belt 21 to be ensured. Therefore, first specific portion 21A of fixing belt 21 can be prevented from contacting or approaching heating source 24. Failure of fixing belt 21 due to excessive heating can thus be prevented.

This configuration also enables a sufficient distance between heating source 24 and third specific portion 21C of fixing belt 21 to be ensured. Therefore, even when third specific portion 21C of fixing belt 21 flaps, third specific portion 21C can be prevented from contacting or approaching heating source 24. Failure of fixing belt 21 due to excessive heating can thus be prevented.

As shown in FIG. 13, fixing apparatus 8E in the present embodiment is configured so that a distance D1 between heating source 24 and erected wall 23*b* of supporting member 23 in paper transport direction DR2 is smaller than a distance D2 between heating source 24 and first specific portion 21A of fixing belt 21 in paper transport direction DR2.

This configuration enables a sufficient distance between heating source 24 and first specific portion 21A of fixing belt 21 to be ensured. Therefore, first specific portion 21A of fixing belt 21 can be prevented from contacting or approaching heating source 24. Failure of fixing belt 21 due to excessive heating can thus be prevented.

In this configuration, erected wall 23*b* of supporting member 23 is located between heating source 24 and third specific portion 21C of fixing belt 21 to thereby shield third specific portion 21C from heating source 24. Therefore, even when third specific portion 21C of fixing belt 21 flaps, third specific portion 21C can be prevented from contacting or approaching heating source 24. Failure of fixing belt 21 due to excessive heating can thus be prevented.

As shown in FIG. 14, in fixing apparatus 8E in the present embodiment, a center position (position indicated by reference P2 in the drawing) of heating source 24 in pressing direction DR1 is located between the opposite ends of erected wall 23*b* of supporting member 23 in pressing direction DR1, as seen in paper transport direction DR2. In other words, the center position of heating source 24 indicated by reference P2 is located within a region R2 shown in FIG. 14.

More specifically, in fixing apparatus RE in the present embodiment, the center position (position indicated by reference P2A in the drawing) of long heater 24A in pressing direction DR1 and the center position (position indicated by reference P2B in the drawing) of short heater 24B in pressing direction DR1 are both located between the opposite ends of erected wall 23*b* of supporting member 23 in pressing direction DR1, as seen in paper transport direction DR2 Namely, the center position of long heater 24A indicated by reference P2A and the center position of short heater 24B indicated by reference P2B are located within region R2 shown in FIG. 14.

This configuration enables increase of the efficiency of space usage, relative to the case where other layouts of heating source 24 are used, and thereby enables a compact fixing apparatus appropriate for energy saving to be produced. Moreover, light radiated from heating source 24 can be reflected highly efficiently by the surface of supporting member 23 or by high-reflectance member 26 attached to the surface of supporting member 23. This light can be used efficiently for heating fixing belt 21. A fixing apparatus appropriate for energy saving can thus be produced.

As seen from the foregoing, fixing apparatus RE in the present embodiment and image forming apparatus 1 including this fixing apparatus can be implemented as a compact fixing apparatus appropriate for energy saving and an image forming apparatus including this fixing apparatus.

The above description of the first to fifth embodiments illustrates the case where the present invention is applied to the so-called tandem-type electrophotographic color printer as well as the fixing apparatus included in the color printer. Uses to which the present invention is applied, however, are not limited to them. The present invention is also applicable to various types of electrophotographic image forming apparatuses and the fixing apparatus included in any of these electrophotographic image forming apparatuses.

Respective configurations of components such as the pressing rotator the heating source, and different kinds of guides described above in connection with the first to fifth embodiments may be modified appropriately within the scope of the invention.

While the above description of the second and third embodiments illustrates the case where one reinforcing auxiliary wall is erected from the base of the supporting member in the direction away from the position of the pressing rotator, more than one reinforcing auxiliary wall may be disposed and more than one reinforcing auxiliary wall may be erected toward the pressing rotator. Further, the reinforcing auxiliary wall may be disposed on the erected wall of the supporting member.

The characteristic features illustrated in connection with the first to fifth embodiments may be combined within the scope of the present invention.

Although embodiments of the present invention have been described and illustrated in detail, it is clearly understood that the same is by way of illustration and example only, not by way of limitation, and the scope of the present invention should be interpreted by terms of the appended claims.

What is claimed is:

1. A fixing apparatus which fixes a toner image on a recording material, the fixing apparatus comprising:
- an endless fixing belt;
- a pad member having (i) a receiving surface facing an inner circumferential surface of the fixing belt, and (ii) a supported surface located opposite to the receiving surface;
- a pressing rotator disposed to face an outer circumferential surface of the fixing belt, and forming a nip portion between the pressing rotator and the outer circumferential surface of the fixing belt, the recording material being transported through the nip portion;
- a supporting member supporting the pad member; and
- a heating source to heat the fixing belt,
- wherein the pressing rotator is rotationally driven, in a state of pressing the fixing belt in a pressing direction toward the receiving surface, to cause the fixing belt to rotate following rotation of the pressing rotator and to slide on the receiving surface, wherein the supporting member includes:
- a base having a flat plate shape, disposed in a space inside the fixing belt, and abutting on the supported surface, and
- an erected wall having a flat plate shape and erected from the base in a direction away from a position of the pressing rotator, the erected wall partitioning the space inside the fixing belt into an upstream space located upstream in a recording-material transport direction in which the recording material is transported, and a downstream space located downstream in the recording-material transport direction, wherein the erected wall is disposed upstream or downstream in the recording-material transport direction, from an intermediate position of the nip portion in the recording-material transport direction, wherein the heating source is disposed in a larger one of the upstream space and the downstream space, and wherein the heating source is disposed between opposite ends of the pad member in the recording-material transport direction, as seen in the pressing direction.

2. The fixing apparatus according to claim 1, wherein:

a center position of the heating source in the pressing direction is located between opposite ends of the erected wall in the pressing direction, as seen in the recording-material transport direction.

3. The fixing apparatus according to claim 1, wherein:

the healing source includes a plurality of rod-like heaters each extending in a direction parallel with an axial direction of the pressing rotator, and the plurality of rod-like heaters are arranged in the pressing direction.

4. The fixing apparatus according to claim 3, wherein:

the plurality of rod-like heaters each have a center position in the pressing direction, and the center position is located between opposite ends of the erected wall in the pressing direction, as seen in the recording-material transport direction.

5. The fixing apparatus according to claim 3, wherein:

the plurality of rod-like heaters consist of:
- a short heater which generates heat from only a region corresponding to a central portion of the pressing rotator in the axial direction of the pressing rotator; and
- a long heater which generates heat from a region corresponding to a substantially whole region of the pressing rotator in the axial direction, and a distance from the pressing rotator to the long heater is longer than a distance from the pressing rotator to the short heater.

6. The fixing apparatus according to claim 1, wherein:

a high-reflectance member having a surface with a reflectance higher than a reflectance of a surface of the supporting member is attached to at least a part of the surface, facing the heating source, of the supporting member.

7. The fixing apparatus according to claim 6, wherein:

the high-reflectance member is attached to at least a part of a surface, facing the heating source, of the erected wall.

8. The fixing apparatus according to claim 1, wherein:

at least a part of a surface, facing the heating source, of the supporting member is formed of a high-reflectance surface higher in reflectance than a remaining part of the surface of the supporting member.

9. The fixing apparatus according to claim 8, wherein:

at least a part of a surface, facing the heating source, of the erected wall is formed of the high-reflectance surface.

10. The fixing apparatus according to claim 1, wherein:

the supporting member has an L-shaped cross section extending continuously from one end of the base in the recording-material transport direction to one end of the erected wall in the pressing direction.

11. The fixing apparatus according to claim 1, wherein:

the supporting member includes, in addition to the erected wall, a reinforcing auxiliary wall erected from the base.

12. The fixing apparatus according to claim 1, wherein:

the supporting member is formed of a single member.

13. The fixing apparatus according to claim 1, wherein:

the erected wall is disposed upstream in the recording-material transport direction from the intermediate position of the nip portion in the recording-material transport direction, and the heating source is disposed in the downstream space.

14. The fixing apparatus according to claim 13, further comprising:

a temperature sensor to detect a temperature of the fixing belt; and a controller to control operation of the heating source based on the temperature detected by the temperature sensor, wherein the temperature sensor is disposed to face an outer circumferential surface of a second specific portion for detecting a temperature of the second specific portion, the second specific portion is a portion of the fixing belt, and the portion defines the upstream space.

15. An image forming apparatus comprising the fixing apparatus according to claim 1 for use in image formation.

* * * * *